US005205226A

United States Patent [19]

Kitto, Jr. et al.

[11] Patent Number: 5,205,226

[45] Date of Patent: Apr. 27, 1993

[54] LOW $NO_x$ BURNER SYSTEM

[75] Inventors: John B. Kitto, Jr., North Canton; Roger J. Kleisley, Plain Twp., Stark County; Albert D. LaRue, Summit; Chris E. Latham, Knox Twp., Columbiana County; Thomas A. Laursen, Canton, all of Ohio

[73] Assignee: The Babcock & Wilcox Company, New Orleans, La.

[21] Appl. No.: 850,600

[22] Filed: Mar. 13, 1992

[51] Int. Cl.[5] ..... F23D 1/02

[52] U.S. Cl. ..... 110/264; 110/263; 110/265; 431/174; 431/178; 431/179; 431/180

[58] Field of Search ..... 110/263, 264, 265, 347; 431/174, 175, 176, 178, 179, 180

[56] References Cited

U.S. PATENT DOCUMENTS

| | | | |
|---|---|---|---|
| 4,150,631 | 4/1979 | Frey et al. | 110/265 X |
| 4,669,398 | 6/1987 | Takahashi et al. | 110/263 X |
| 5,020,454 | 6/1991 | Hellewell et al. | 110/264 |

OTHER PUBLICATIONS

Comprehensive Report to Congress—Clean Coal Technology Program, U.S. Department of Energy—Jul. 1990-DOE/FE-0197P-pp. 1-35.

Babcock & Wilcox Technical Paper BR-1370-"$NO_x$ Control Update—1989"-LaRue & Cioffi, Presented to 1989 Jt. Symposium on Stationary Combustion $NO_x$ Contro-San Francisco, Calif.-Mar. 5-9, 1989.

Babcock & Wilcox Technical Paper BR-1392-"-Coal-Fired $NO_x$ Emission Control Technologies'-'-Kitto, LaRue & Kulig, Presented to 6th Annual International Pittsburgh Coal Conference-Pittsburgh, Pa.--Sep. 25-29, 1989.

Babcock & Wilcox Technical Paper PGTP85-18-'-'Utility Steam Generator $NO_x$ Control Update-1985-"-LaRue, Acree & Cioffi, Presented to 1985 Joint Symposium on Stationary Combustion $NO_x$ Control-Boston, Mass.-May 6-9, 1985.

Babcock & Wilcox Paper Titled "Development of Low $NO_x$ Cell Burners for Retrofit Applications"-LaRue & Rodgers, presented at a 1985 Joint EPA/EPRI $NO_x$ Symposium in Boston, Mass.-May, 1985-17 pages.

Asme Paper 86-JPGC-FACT-G-"Development of a Retrofit Low $NO_x$ Cell Burner"-Clark LaRue, Liang & Eskinazi-Presented at the Jt. Asme/IEEE Power Gen. Conference-Portland, Or.-Oct. 19-23, 1986.

Babcok & Wilcox Environmental Systems Information Brochure Dated Nov. 15, 1990-"LNCB T-M-Low-$NO_x$ Cell Burner" ®1990 The Babcock & Wilcox Company.

Babcock & Wilcox Technical Paper-"$NO_x$ Control Update-1987"LaRue & Ciffi, Presented to Jt. Symposium on Stationary Combustion $NO_x$ Control-New Orleans, L.A.-Mar. 23-27, 1987 Paper No. BR-1306.

Babcock & Wilcox Technical Paper PGTP87-13-"-Large Scale Testing and Development of the B & W Low $NO_x$ Cell Burner"-Clark, LaRue, Liang & Eskuazi, Presented to Jt. Symposium on Stationary Combustion $NO_x$ Control-New Orleans, L.A.-Mar. 23-27, 1987.

(List continued on next page.)

*Primary Examiner*—Edward G. Favors

*Attorney, Agent, or Firm*—Vytas R. Matas; Robert J. Edwards; Eric Marich

[57] ABSTRACT

A low $NO_x$ burner system for a furnace having spaced apart front and rear walls, comprises a double row of cell burners on each of the front and rear walls. Each cell burner is either of the inverted type with a secondary air nozzle spaced vertically below a coal nozzle, or the non-inverted type where the coal nozzle is below the secondary air port. The inverted and non-inverted cells alternate or are provided in other specified patterns at least in the lower row of cells. A small percentage of the total air can be also provided through the hopper or hopper throat forming the bottom of the furnace, or through the boiler hopper side walls. A shallow angle impeller design also advances the purpose of the invention which is to reduce CO and $H_2S$ admissions while maintaining low $NO_x$ generation.

20 Claims, 8 Drawing Sheets

OTHER PUBLICATIONS

Babcock & Wilcox Technical Paper BR-1352A (RdTPA 88-34)-"$NO_x$ Emission Reductions-Selected Coal-Fired Retrofit Options"-Kulig & Kitto, Jr.-Presented at the Power Gen Conference, Orlando, Fla.--Dec. 6-8, 1988.

B&W Paper-"Retrofit Comb. Modifications for $NO_x$ Control in Utility Boilers-From Pilot Scale to Full-Scale Development"-Rodgers, et al Presented at the 1990 Fall Symposium-American Flame Research Committee-San Francisco, Calif.-Oct. 8-10, 1990.

Babcock & Wilcox Technical Paper BR-1452 -"Update on B & W Low $NO_x$ Combustion Systems"-LaRue et al-Presented to Intl. Jt. Pwr, Gen. Conference-San Diego, Calif., Oct. 6-10, 1991.

B & W Paper Titled "Use of Numerical Modeling in the Design of a Low-$NO_x$ Burner for Utility Boilers"--Fiveland & Latham-Presented to 1st Intl. Conf. on Comb. Technologies for A Clean Environemnt-Sep. 3-6, 1991-Vilamoura, Portugal.

Draft of a B & W Technical Paper BR-1474-"Preliminary Results from Phase II, Group II Low-$NO_x$ Clean Coal Retrofit Demonstrations"-Kleisley, et al-To Be Presented at Air & Waste Mgt. Assoc. Conf., Kansas City, Mo.-Jun. 21-26, 1992 (Mailed Mar. 16, 1992).

LOW $NO_x$ BURNER SYSTEM

FIELD AND BACKGROUND OF THE INVENTION

The present invention relates in general to Low $NO_x$ Cell TM burners in large scale utility boilers, and in particular, to a new and useful cell burner arrangement which utilizes one or more inverted cells, in conjunction with or independently of excess air injected through a lower hopper throat of the boiler furnace or through the side walls of the burner furnace, and further either in conjunction with or independently of shallow angle impellers in the burners of the cells, for significantly reducing CO and $H_2S$ gaseous concentrations in addition to providing low $NO_x$ characteristics.

Standard cell and Low $NO_x$ Cell burners are known for use in the furnace of boilers, in particular, in utility size boilers. A standard cell burner comprises a pair of closely and vertically spaced coal burners with nozzles and air supplies for producing a dual flame in the furnace wall. In a Low $NO_x$ Cell burner, the upper coal nozzle is replaced by a secondary air port having louvers and other secondary air directing mechanisms for use in conjunction with the lower coal burner nozzle. The lower nozzle is enlarged to accommodate the same fuel input capacity as the two nozzles in the standard design.

It is also known to use one or two rows of Low $NO_x$ Cell burners in the front and rear walls of a utility boiler furnace, with the louvered secondary air port always occupying the upper position in each cell.

One advantage of the Low $NO_x$ Cell design is that it can be retrofit into existing boilers utilizing the standard cell burner architecture.

A number of tests have revealed that while $NO_x$ reductions are enjoyed by the retrofit furnaces, unexpectedly high carbon monoxide (CO) and hydrogen sulfide ($H_2S$) concentrations have been found in the ash hopper of the furnace. The high CO concentration may represent a safety and health risk for plant personnel working near the pressure-fired units in the event of a furnace gas leak. The high $H_2S$ concentrations can increase furnace wall tube corrosion rates.

The construction of a standard Low $NO_x$ Cell burner, including a coal nozzle and a secondary air port, is disclosed in "Comprehensive Report to Congress Clean Coal Technology Program", U.S. Department of Energy, July 1990. Also see, two technical papers by Babcock and Wilcox, entitled "$NO_x$ Control Update-1989", BR-1370, Mar. 5–9, 1989, and "Coal-Fired $NO_x$ Emission Control Technologies", BR-1392, Sep. 25–29, 1989. The retrofitting of Low $NO_x$ Cell burners, to replace standard double burners, is also disclosed in "Development of a Retrofit Low $NO_x$ Burner", M. J. Clark, et al., J. ASME/IEEE Power Generation Conference, Oct. 19–23, 1986.

SUMMARY OF THE INVENTION

An object of the present invention is to provide an arrangement of Low $NO_x$ Cell burners which reduces the CO and $H_2S$ concentrations in the hopper of a boiler furnace, without significantly effecting the unit performance.

A further object of the present invention is to provide at least one inverted cell in the arrangement, which utilizes a secondary air port position below the coal nozzle, in particular, for the lower row of cells. The arrangement of the invention provides enough oxygen to the hopper to allow most of the CO to form $CO_2$, which also hinders the formation of $H_2S$.

A still further object of the present invention is to enhance conversion of CO to $CO_2$ utilizing about 2 to 10% of the total air supplied either at the bottom of the hopper or through the side walls of the furnace, near the hopper.

A still further object of the present invention is to provide the burners in at least some of the cells with shallow angle impellers, to further improve CO and $H_2S$ reduction and to improve flame size, shape and position.

Still further, an object of the present invention is to provide an arrangement for pressurized units having reduced safety and health risks and reduced potential for furnace wall corrosion. This is accomplished without requiring any changes to the boiler pressure parts.

CO concentrations were also reduced without significantly changing furnace heat transfer characteristics.

A further object of the invention is to provide a low $NO_x$ burner system for a furnace having spaced apart front and rear walls connected between spaced apart side walls, the furnace including a lower hopper, the system comprising: a plurality of cell burners lying along at least one horizontal row in at least one of the front and rear walls, each cell comprising a coal nozzle for projecting a primary air plus coal mixture into the furnace, and a secondary air port spaced vertically from the coal nozzle for supplying secondary air into the furnace at a vertically spaced yet adjacent location to the primary air plus coal mixture supplied to the furnace, at least one of the cells having its secondary air port spaced vertically below its coal nozzle and representing an inverted cell, at least some remaining cells in the at least one horizontal row having a secondary air port spaced above the coal nozzle and representing a non-inverted cell; means for supplying primary air and coal to the coal nozzle; and means for supplying secondary air to the secondary air ports.

A further object of the present invention is to provide a low $NO_x$ burner system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
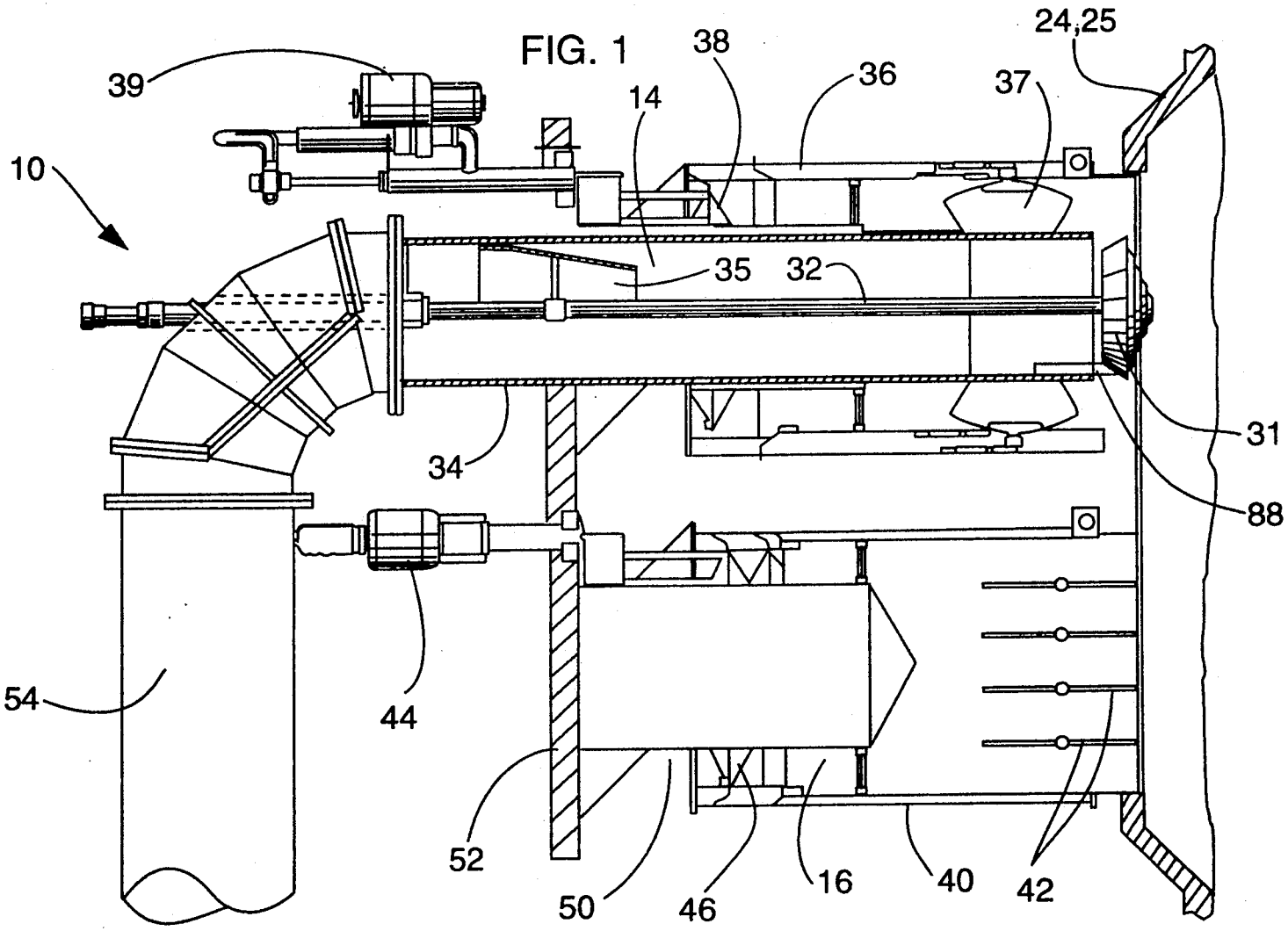
FIG. 1 is a sectional view of an inverted Low $NO_x$ Cell burner according to the present invention.
Figure 2:
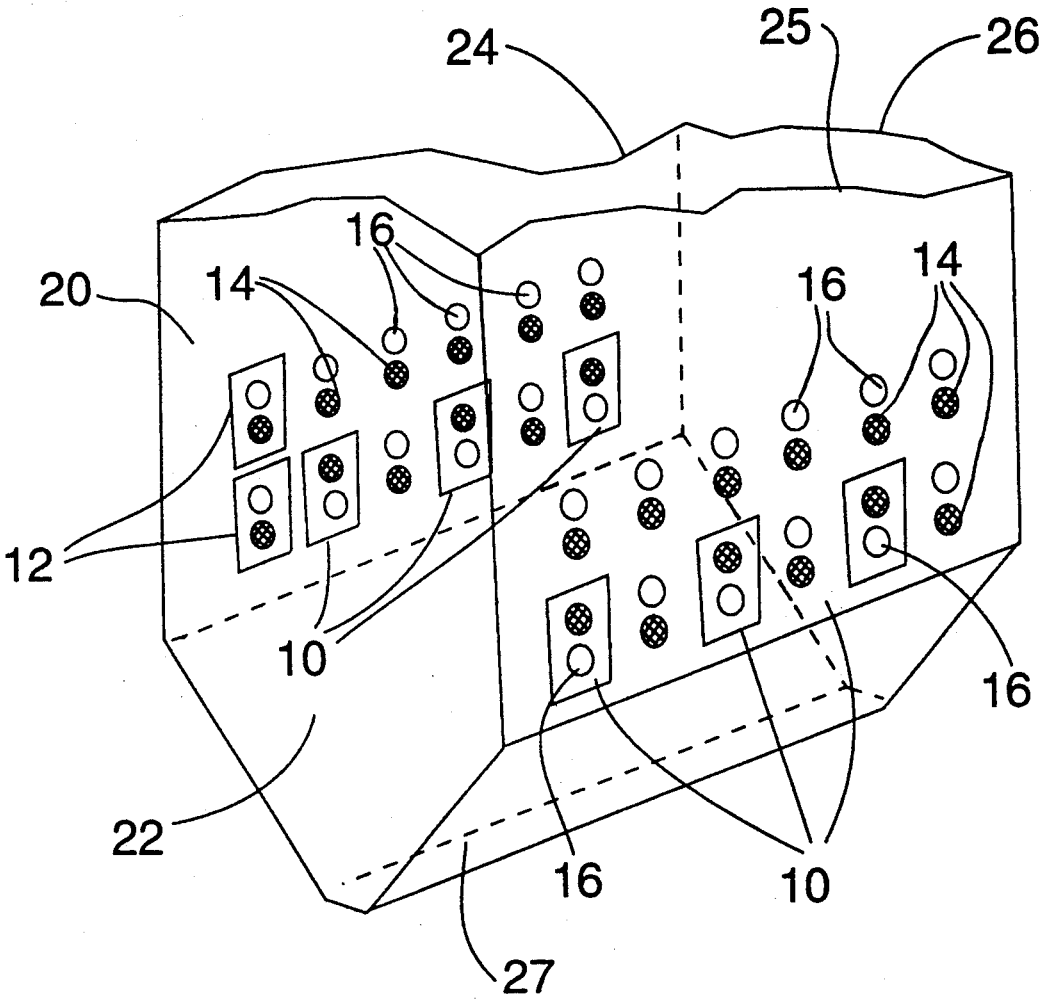
FIG. 2 is a schematic perspective view of a utility boiler furnace utilizing multiple cells in the system of the present invention.
Figure 3:
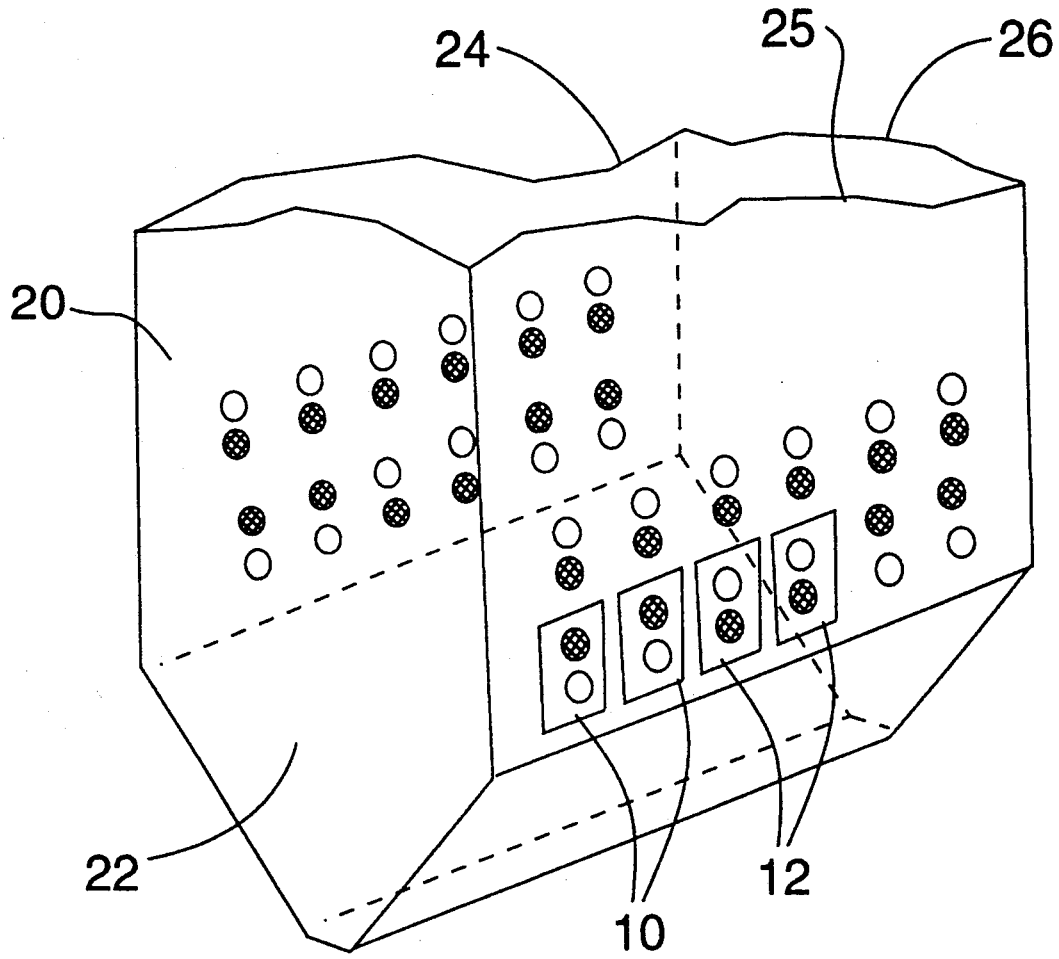
FIG. 3 is a view similar to FIG. 2 of another embodiment of the invention.

Referring to the drawings in particular, the invention embodied in FIGS. 1 and 2, comprises a low $NO_x$ burner system comprising some inverted Low $NO_x$ Cell burners generally designated 10, used in conjunction with known, non-inverted cells 12, servicing a boiler, for example, a large utility boiler, having a furnace 20. The cells each include a single coal burner or coal nozzle 14 which is mounted either below (in the non-inverted cell) or above (in the inverted cell) a secondary air port 16 used to provide secondary air in the immediate vicinity of the flame discharged from the burner 14. In FIGS. 2–6, the secondary air nozzles 16 are each shown as open circles while the coal burners 14 are shown as hatched circles.

Turning once more to FIG. 2, furnace 20 comprises a rear wall 24, a front wall 25 and a pair of opposite side walls 26. Furnace hopper 22 includes a throat or opening 27. Throughout the figures, the same reference numerals are utilized to designate the same or functionally similar parts.

Figure 4:
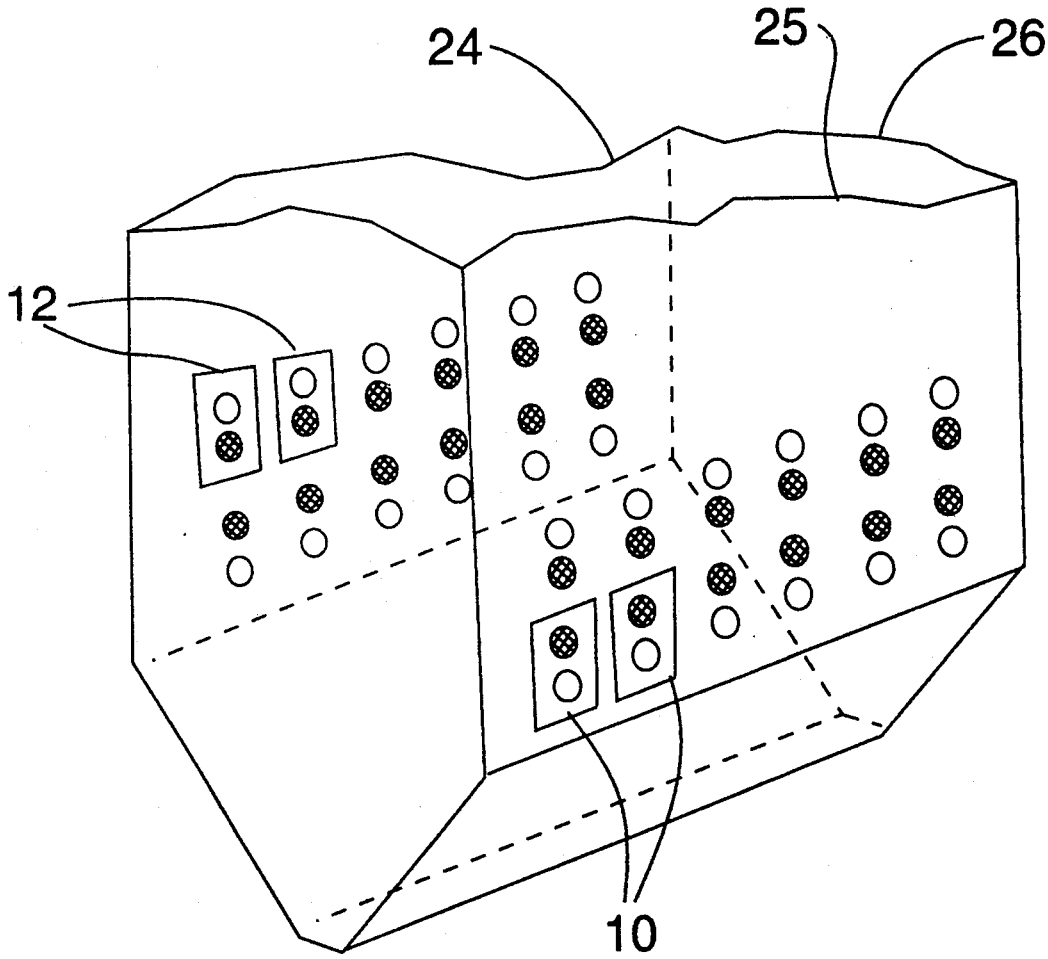
FIG. 4 is a view similar to FIG. 2 of a further embodiment of the invention.
Figure 5:
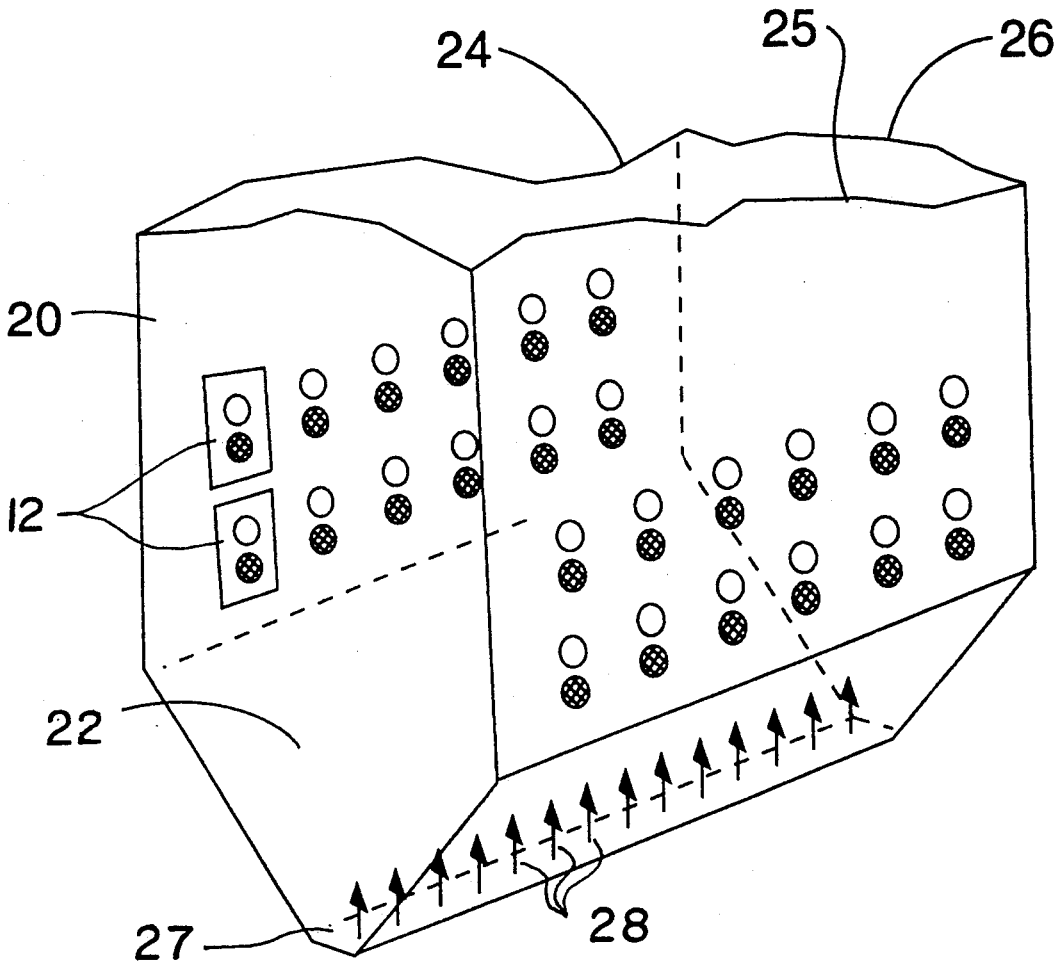
FIG. 5 is a view similar to FIG. 2 of an arrangement according to the invention utilizing excess secondary air supplied through the furnace hopper.

As shown in FIG. 5, which illustrates another feature of the invention utilizing excess secondary air inlets 28 in the hopper throat or opening 27, a conventional pattern of non-inverted cells 12 is utilized, where 12 cells in two vertically spaced horizontal rows are applied to the front and rear walls for directing coal fired flames into the furnace 20. The inverted pattern of one or more cells in each row of cells, to be described in connection with FIGS. 2–4, can be used as either the upper, lower or both rows, replacing the non-inverted cells of FIG. 5.

As shown in FIG. 2, one arrangement of inverted cells alternates between inverted and non-inverted cells across the lower row of cells only in the rear and front walls 24, 25. Each inverted cell 10 on the front wall 25 faces directly opposite a non-inverted cell 12 on the rear wall 24. This arrangement has been found to advantageously circulate secondary air in the hopper and lower furnace portion of the boiler, to minimize $NO_x$ generation as well as reduce CO and $H_2S$ production.

The fundamental object and key of the present invention is to produce a favorable air flow pattern in the bottom of the furnace.

Another arrangement for producing this advantageous flow pattern is illustrated in FIG. 3 where again only the lower row of cells include inverted cells, and every two inverted cells 10 is alternated with two non-inverted cells 12. In this embodiment of the invention, the orientation of cells, that is whether they are inverted or non-inverted, face likewise oriented cells between the front and rear walls of the furnace 20.

FIG. 4 shows a still further embodiment of the invention where all cells in the lower row are inverted cells 10, all cells in the upper row being non-inverted cells 12.

Figure 4A:
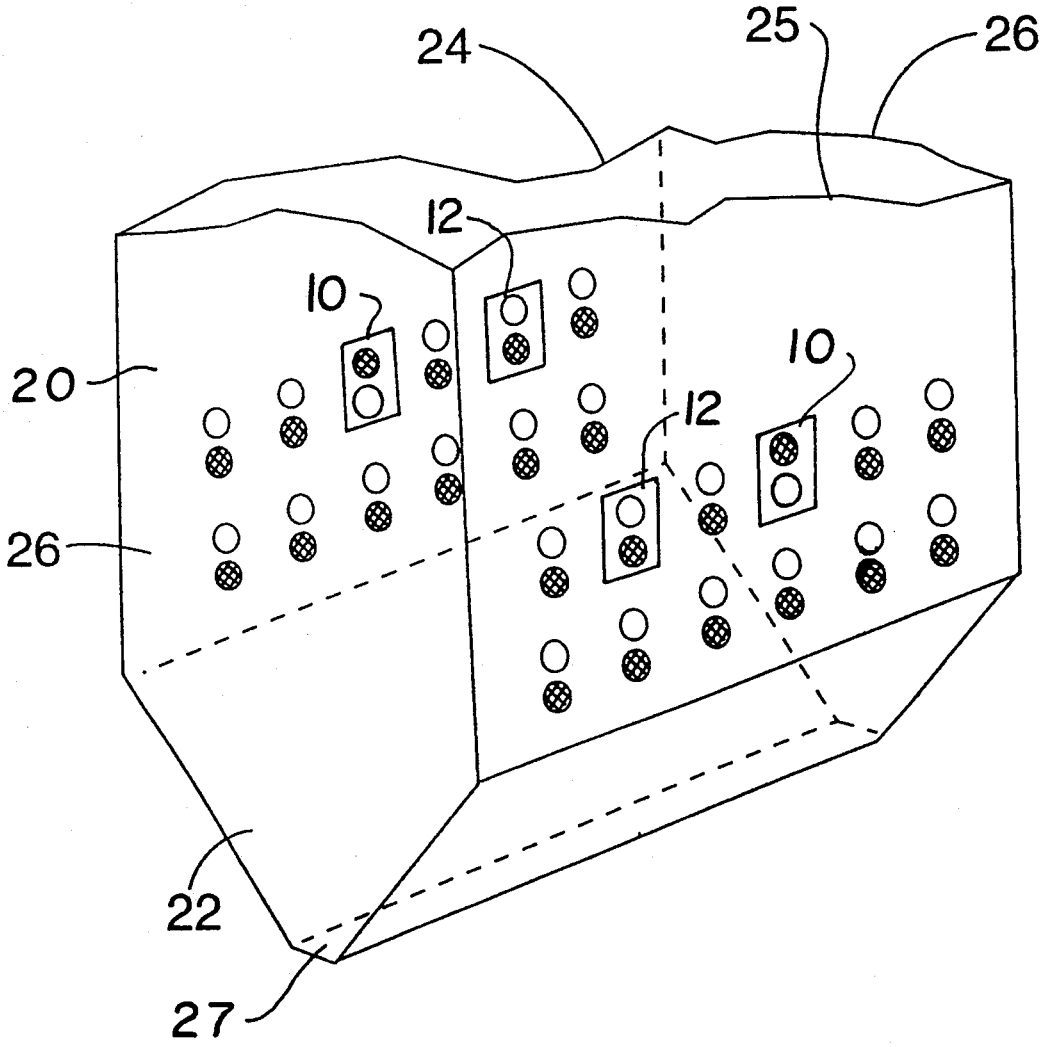
FIG. 4A is a view similar to FIG. 2 of a further embodiment of the invention.

FIG. 4A shows a still further embodiment of the invention wherein at least one cell in the upper row of each of the front and rear walls is inverted.

Other patterns of inverted and non-inverted cells utilize inverted cells only on the outside of the lower rows, adjacent the side walls 26. Other alternatives include providing the inverted plus non-inverted cell pattern in the upper row as well, in both the upper and the lower row or on upper and lower rows on either one or both of a front and rear wall of the furnace.

FIG. 5 illustrates a further embodiment of the invention which can be used either with the conventional entirely non-inverted cell pattern shown in FIG. 5, or with any of the previously described inverted plus non-inverted pattern options.

According to the embodiment of FIG. 5, approximately 3% of the total air, is supplied through secondary air inlets 28 in the throat 27 of the hopper 22. This has been found to improve CO and $H_2S$ reduction while not adversely affecting the efficiency of the furnace.

Figure 6:
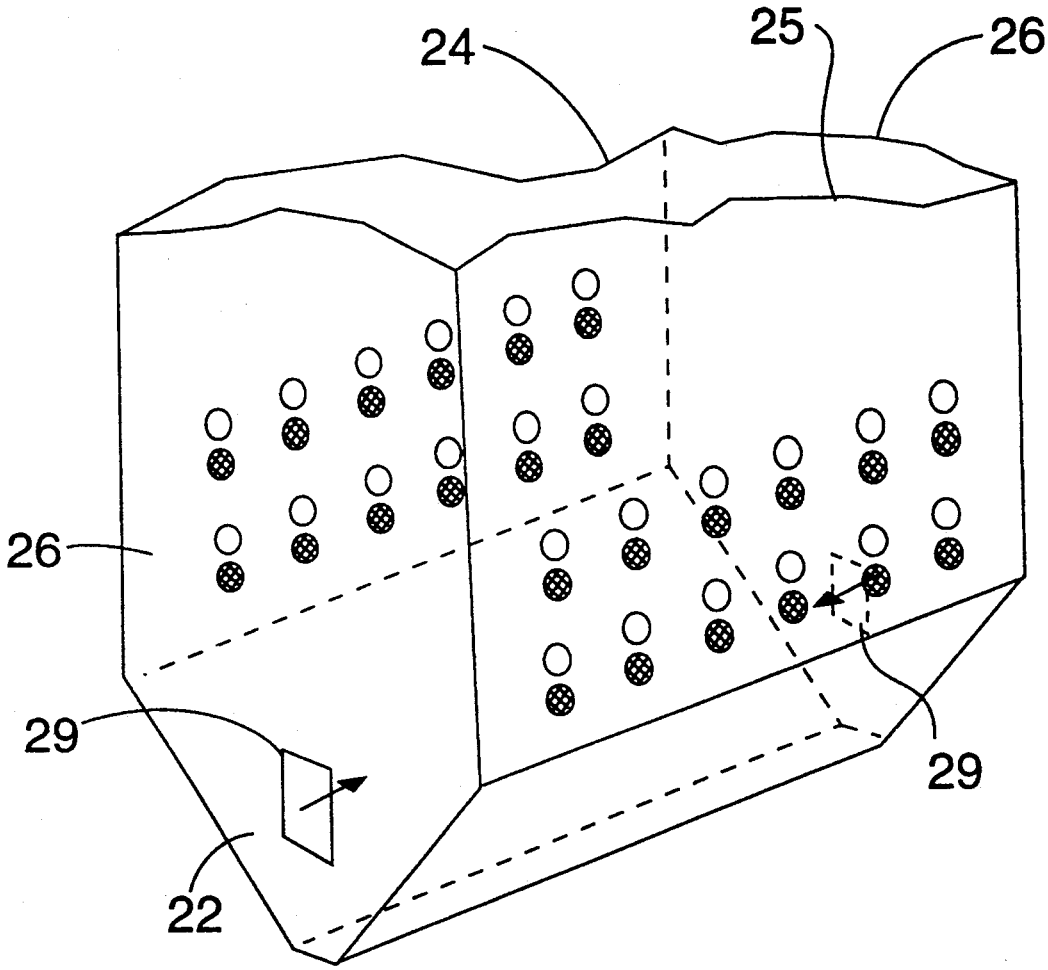
FIG. 6 is a view similar to FIG. 2 of an embodiment utilizing excess secondary air supply through the side walls of the furnace hopper.

FIG. 6 illustrates a further modification of the invention where a pair of secondary air inlets 29 are provided in the side walls 26 for injecting about 7% total air into the hopper 22. Here again, the cell pattern for the front and rear walls can be either the conventional fully non-inverted pattern or any combination of inverted plus non-inverted patterns described previously in this disclosure.

Accordingly, between about 2 and about 10% of the total air can be injected into the hopper portion of the invention, with or without the inverted cell option, to further improve CO and $H_2S$ reduction while maintaining low $NO_x$ operation.

Figure 8:
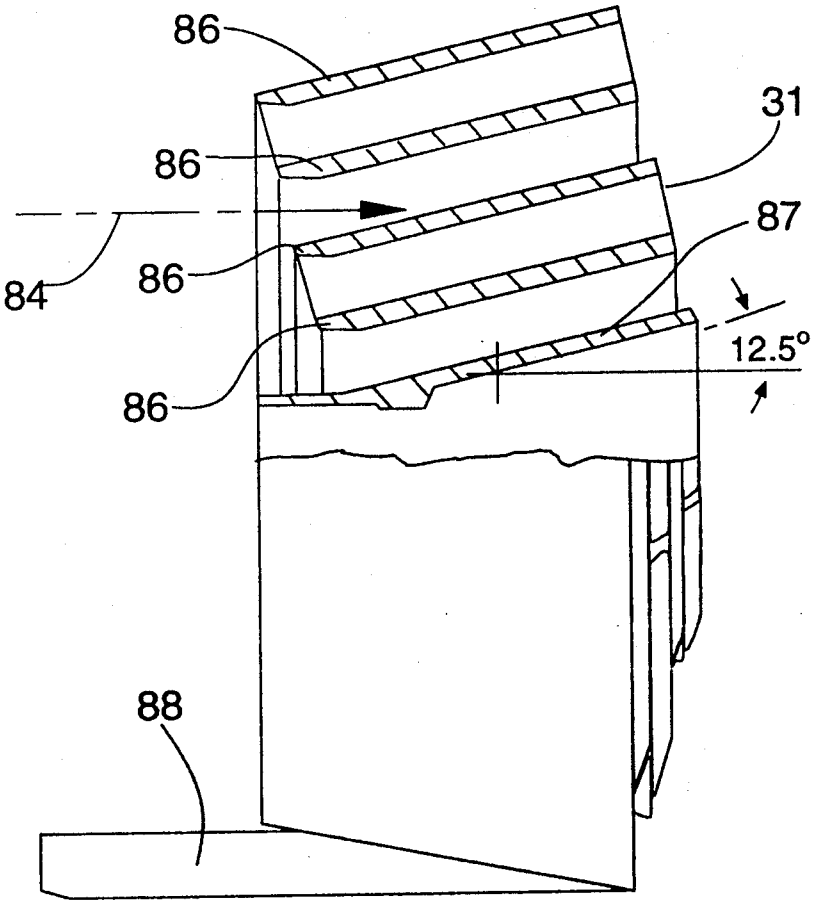
FIG. 8 is a view similar to FIG. 7 showing an improved shallow angle impeller according to the present invention.
Figure 7:
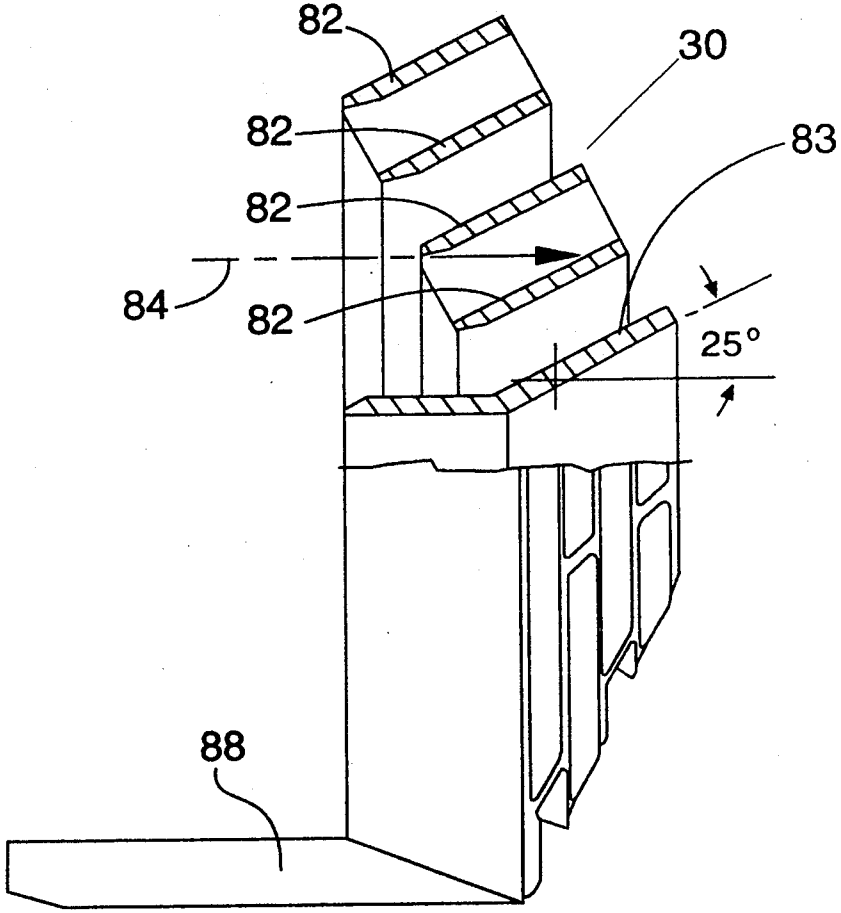
FIG. 7 (PRIOR ART)
FIG. 7 is a side elevational view, partially in section showing a known coal impeller design having a 50° characteristic.

FIG. 7 shows a conventional coal impeller design 30 which is contrasted in having a steeper angle than a shallow angle impeller design shown in FIG. 8 and used in conjunction with the present invention.

The known impeller of FIG. 7 is known as a 50° impeller while a shallow angle 25° impeller is illustrated in FIG. 8. The 50° or 25° characterization of the coal impellers in FIGS. 7 and 8 is arrived at in that each of the five vanes 82, 83 in the prior art impeller, is at 25° to the longitudinal axis through the impeller. The primary air plus coal flow illustrated schematically at line 84, thus experiences a 50° impeller effect around the circumference of the impeller. In likewise fashion, the shallow angle impeller of FIG. 8 has five blades 86, 87 which are each at 12.5° to the axis of the impeller, thus forming a total included impeller angle of 25° for the primary air plus coal flow 84.

Because of the shallow angle, the length of each impeller blade must be increased according to the invention of FIG. 8. The object is to avoid a straight line of sight through the impeller for the primary air plus coal flow 84. At least some deflection of the mixture outwardly is required.

Both the impellers of the prior art and the impellers of the invention can be translated axially within an inner conduit of the coal nozzle, as will be discussed in greater detail later in this disclosure. Each impeller of the prior art and each impeller of the present invention has three circumferentially spaced feet 88, separated by 120° each around the circumference of the impeller, for centering and allowing axial movement of the impeller within the inner conduit.

According to the present invention, a shallow angle impeller has an axially length and number of blades to preclude line of site passage of the primary air plus coal mixture, with blades line at compound angles of 20°-30° (that is, each blade makes an angle of 10°-15° with the axis of the impeller).

It has been found that the shallower angle produces a longer flame which is more adapted to the furnace size.

Returning to FIG. 1, impeller 31 is connected to a shaft 32 and can be retracted or advanced to change the shape of the flame. Retracting into conduit 34 lengthens the flame and extending the impeller shortens the flame. The feet 88 guide the axial movement of the impeller 31 along the inner surface of the primary air plus pulverized coal conduit 34 which receives a primary air plus coal mixture that is forced along the conduit, and past a distribution cone 35, from supply means 54.

Secondary air is supplied around the mixture of primary air and coal, through a secondary air conduit 36. Adjustable spin vanes 37 are circumferentially spaced around the outlet end of conduit 34 and can be titled to adjust the spinning movement of the secondary air.

A sliding air damper 30 with damper control 39 is also provided for regulating the amount of secondary air.

The separate secondary air port 16 comprises a conduit 40 which contains a plurality of vertically spaced and pivotally mounted louver dampers 42 which can be controlled for adjusting the angle of entry for secondary air into the furnace which has been found to reduce $NO_x$ production.

A sliding air damper control 44 is connected to a sliding air damper 46 for adjusting the amount of secondary air supplied through port 16.

Secondary air can be provided to the secondary air ports 16 and the secondary air conduits 36 of the coal nozzles 14, by means of a secondary air plenum 50 defined between the front or rear furnace wall 24, 25 and a plonum wall 52 spaced outwardly from the furnace.

While the specific embodiments of the invention have been shown and described in detail to illustrate the application of the principles of the invention, it will be understood that the invention may be embodied otherwise without departing from such principles.

What is claimed is:

1. A low $NO_x$ burner system for a furnace having spaced apart front and rear walls connected between spaced apart side walls, the furnace including a lower hopper, the system comprising:

a plurality of cell burners lying along at least one horizontal row in at least one of the front and rear walls, each cell comprising a coal nozzle for projecting a primary air plus coal mixture into the furnace, and a secondary air port spaced vertically from the coal nozzle for supplying secondary air into the furnace at a vertically spaced yet adjacent location to the primary air plus coal mixture supplied to the furnace, at least one of the cells having its secondary air port spaced vertically below its coal nozzle and representing an inverted cell, at least some remaining cells in the at least one horizontal row having a secondary air port spaced above the coal nozzle and representing a non-inverted cell;

means for supplying primary air and coal to the coal nozzles; and means for supplying secondary air to the secondary air ports.

2. A system according to claim 1, including a plurality of cell burners in each of the front and rear walls of the furnace, lying in two vertically spaced horizontal rows.

3. A system according to claim 2, wherein all cells in an upper one of the rows in each wall comprise non-inverted cells, at least some of the cells in a lower horizontal row in each of the front and rear walls being inverted cells.

4. A system according to claim 3, wherein alternating cells in the lower rows are inverted cells and remaining cells in the lower rows are non-inverted cells.

5. A system according to claim 4, wherein each inverted cell in the lower row of the rear wall faces a non-inverted cell in the lower row of the front wall.

6. A system according to claim 3, wherein at least the cells adjacent the side walls are inverted.

7. A system according to claim 3, wherein every two cells in the lower rows of each of the front and rear walls alternate between inverted and non-inverted cells.

8. A system according to claim 3, wherein all cells in the lower row of each of the front and rear walls are inverted.

9. A system according to claim 2, wherein at least one cell in the upper row of each of the front and rear walls is inverted.

10. A system according to claim 2, wherein all cells in the upper rows of the front and rear wall are non-inverted.

11. A system according to claim 1, including supplying at least some portion of the total air into the furnace through the hopper.

12. A system according to claim 11, wherein the portion of the total air is supplied through a lower throat of the hopper in an amount of 2 to 10% of the total air.

13. A system according to claim 11, wherein the portion of the total air is supplied through at least one of the side walls in an area of the hopper, in an amount of between 2 to 10% of the total air.

14. A system according to claim 1, wherein each coal nozzle comprises an inner conduit for conveying a primary air plus coal mixture, the inner conduit having an open end at one of the front and rear walls of the furnace, a coal impeller at the front end of the inner conduit, a secondary air conduit around the inner conduit defining a passage for secondary air into the furnace, the impeller having a shallow angle characteristic for projecting the primary air plus coal mixture into the furnace.

15. A low $NO_x$ burner system for a furnace having spaced apart front and rear walls connected between spaced apart side walls, the furnace including a lower hopper, the system comprising:

a plurality of cell burners lying along at least one horizontal row in at least one of the front and rear walls, each cell comprising a coal nozzle for projecting a primary air plus coal mixture into the furnace, and a secondary air port spaced vertically from the coal nozzle for supplying secondary air into the furnace at a vertically spaced yet adjacent location to the primary air plus coal mixture supplied to the furnace;

means for supplying primary air and coal to the coal nozzle;

means for supplying primary air and coal to the coal nozzles;

means for supplying secondary air to the secondary air ports; and means for supplying from 2 to 10% of the total air through the hopper into the furnace.

16. A system according to claim 15, wherein the hopper has a throat, the 2 to 10% of the total air being supplied through the throat.

17. A system according to claim 15, wherein the 2 to 10% of the total air is supplied through at least one of the side walls of the furnace in an area of the hopper.

18. A low $NO_x$ burner system for a furnace having spaced apart front and rear walls connected between spaced apart side walls, the furnace including a lower hopper, the system comprising:

a plurality of cell burners lying along at least one horizontal row in at least one of the front and rear walls, each cell comprising a coal nozzle for projecting a primary air plus coal mixture into the furnace, and a secondary air port spaced vertically from the coal nozzle for supplying secondary air into the furnace at a vertically spaced yet adjacent location to the primary air plus coal mixture supplied to the furnace;

means for supplying primary air and coal to the coal nozzles;

means for supplying secondary air to the secondary air ports; and each coal nozzle including an inner conduit for carrying a primary air plus coal mixture into the furnace, each inner conduit having a front end near the front or rear wall of the furnace, an outer conduit around the inner conduit defining a space for secondary air around the inner conduit and into the furnace, and a shallow angle impeller at the front end of the inner conduit.

19. A burner system according to claim 18, wherein the shallow angle impeller has a number of blade and axial length to preclude line of site passage of the primary air plus coal mixture through the impeller, the impeller blades being at compound angles of from 20°-30°.

20. A system according to claim 19, wherein the compound angle is 25°.

* * * * *

UNITED STATES PATENT AND TRADEMARK OFFICE

CERTIFICATE OF CORRECTION

PATENT NO. : 5,205,226

DATED : Apr. 27, 1993

INVENTOR(S) : John B. Kitto, Jr., Roger J. Kleisley, Albert D. LaRue, Chris E. Latham, and Thomas A. Laursen

It is certified that error appears in the above-identified patent and that said Letters Patent is hereby corrected as shown below:

In Col. 1, after line 1 and before "FIELD AND BACKGROUND OF THE INVENTION", insert the following paragraph:

--The Government of the United States of America has rights in this invention pursuant to Contract No. DE-FC22-90PC90545 awarded by the U.S. Department of Energy.--.

Signed and Sealed this

Twelfth Day of July, 1994

*Attest:*

Bruce Lehman

BRUCE LEHMAN

*Attesting Officer*

*Commissioner of Patents and Trademarks*